United States Patent [19]

Breidenbach et al.

[11] 4,430,951

[45] Feb. 14, 1984

[54] PROCESS FOR CLEANING OF FLUE GASES OF A POWER PLANT WITH THE AID OF A COAL DUST BURNING FLAME AND APPARATUS FOR CARRYING OUT THE PROCESS

[75] Inventors: Heribert Breidenbach, Essen; Strauss Udo, Bochum, both of Fed. Rep. of Germany

[73] Assignee: Steag AG, Essen, Fed. Rep. of Germany

[21] Appl. No.: 412,105

[22] Filed: Aug. 27, 1982

[30] Foreign Application Priority Data

Sep. 15, 1981 [DE] Fed. Rep. of Germany ..... 3136480

[51] Int. Cl.[3] ..... F23J 11/00

[52] U.S. Cl. ..... 110/345; 110/205; 110/215; 110/216; 110/254

[58] Field of Search ..... 122/1 A; 110/254, 203, 110/210, 205, 204, 215, 216, 345

[56] References Cited

U.S. PATENT DOCUMENTS

| | | | |
|---|---|---|---|
| 1,628,609 | 5/1927 | Newhouse | 110/205 |
| 3,742,874 | 7/1973 | Eff | 110/216 |
| 3,794,565 | 2/1974 | Bielski et al. | 110/119 |
| 3,861,334 | 1/1975 | Stockman | 110/205 |
| 3,932,280 | 1/1976 | Anderson | 110/215 |
| 4,149,453 | 4/1979 | Reed | 110/160 |
| 4,223,640 | 9/1980 | Rochford et al. | 110/254 |
| 4,277,362 | 7/1981 | Mallek et al. | 110/219 |
| 4,335,663 | 6/1982 | Terrell | 110/216 |
| 4,344,920 | 8/1982 | Isserlis | 110/216 |

*Primary Examiner*—Henry C. Yuen

*Attorney, Agent, or Firm*—Andrus, Sceales, Starke & Sawall

[57] ABSTRACT

In the process for cleaning of flue gases of a power plant boiler, the flue gases are dust filtered at first and then wet desulfurized. By the wet desulfurization the flue gases are cooled down and have to be reheated before they are fed to the stack of the power plant. In known processes the flue gases to be reheated are reheated by a flame burning oil or gas. This reheating is expensive and leads to the handling and storage of a further fuel in the power plant. In order to avoid this disadvantages, according to the invention the flue gases are reheated by means of reheating energy of at least one reheating flame burning coal dust. Coal dust is a fuel which is available in a power plant, the power burners of which burn coal dust.

10 Claims, 2 Drawing Figures

PROCESS FOR CLEANING OF FLUE GASES OF A POWER PLANT WITH THE AID OF A COAL DUST BURNING FLAME AND APPARATUS FOR CARRYING OUT THE PROCESS

BACKGROUND OF THE INVENTION

The invention relates to a process for cleaning of flue gases of a coal dust fired power plant boiler, in which the flue gases of the boiler are dust filtered, wet desulfurized and thereafter reheated by means of a reheating energy from at least one reheating flame burning a fuel.

From "Jahrbuch der Dampferzeugungstechnik", 4th edition (1980/1981), Vulkan-Verlag, Essen, pp 731–734) it is known to reheat flue gases having been cooled down in a wet desulfurization by means of a oil- or gas-fired burner. In a burning chamber, which is either fired with gas, light oil or heavy oil, a hot flue gas stream is generated, which is admixed to the gas stream leaving the desulfurization device or a part of that stream, as it is especially described on p 733, FIG. 8*b*.

The feeding of the reheating burner with gas or oil leads to an increase of the power plant operation costs and makes it necessary to provide a further fuel besides the coal dust fired in the boiler furnace.

It is, therefore, the purpose of the invention to provide a process in which the operational costs are decreased and in which no additional type of fuel is necessary.

SUMMARY OF THE INVENTION

This problem is solved according to the invention by a process for cleaning of flue gases of a coal dust fired power plant boiler which comprises dust filtering of the flue gases, wet desulfurizing of the flue gases and reheating the flue gases by means of reheating energy from at least one reheating flame burning coal dust.

Coal dust is available in coal dust fired power plants for the operation of the power burners. Further, it is known to use, in power plants coal dust for the ignition and support fire. Especially the coal dust burners designed for the ignition and support fires are well adapted for the use in the reheating of the flue gases behind flue gas desulfurization devices.

There are different possibilities to add the heat energy of the coal dust flame to the flue gas, which is to be reheated. It is possible to at first remove the dust from the flue gases of the reheating flame and thereafter mix the gases with the cleaned flue gases of the power plant boiler.

Further, there is the possibility that a heat exchange is performed between the flue gases of the reheating flame and the boiler flue gases to be reheated, e.g. by means of a gas-gas-countercurrent heat exchanger or a heat exchanger of the rotary air preheating type. From the above mentioned book it is known to reheat the wet desulfurized flue gases by means of a steam heat exchanger or a rotary heat exchanger, which is arranged between the hot, not yet desulfurized gas and the cooled desulfurized gas, but this literature makes the use of a coal dust burner not obvious.

The admixture of the dust filtered flue gases of the reheating flame is especially useful in case of the operation of the burner with coal dust of low sulfur content, whereas the heat exchange and the addition of the flue gases of the reheating flame to the not yet desulfurized flue gases of the boiler makes the use of a coal rich in sulfur for the reheating flame possible.

The invention also provides apparatus for carrying out the process according to the invention and comprising a dust filter fed with the boiler flue gases, a wet desulfurization device connected to the dust filter and at least one dust burner arranged in a burning chamber and adapted to burn coal dust.

Two examples of the process will be explained more fully with reference to the drawings.

DETAILED DESCRIPTION OF THE PREFERRED EMBODIMENTS

Figure 1:
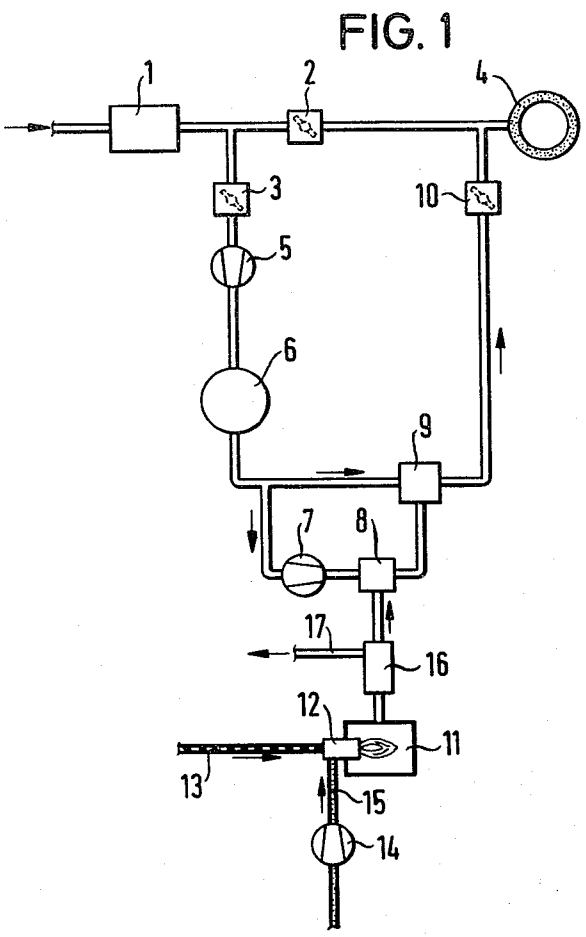
FIG. 1 shows diagrammatically apparatus, with which the flue gases of the reheating flame are admixed to the flue gases to be reheated

In the embodiment according to FIG. 1 the flue gases from a power plant boiler (not shown) are fed to an electrostatic filter 1. The flue gases leaving the electrostatic filter can be parted by means of valves 2 and 3 in part streams, the one of which is directly let to a stack 4 and the other is fed via a blower 5 to a wet desulfurizing desulfurization device 6 (REA). The flue gases leaving the REA 6 and being cleaned and cooled down are parted—in case of this embodiment—in two part streams, one part stream being led via a blower 7 to a mixing chamber 8. The part stream leaving the mixing chamber 8 is united at 9 with the other part stream and the united part streams are fed via a valve 10 to the non-cleaned part stream before the stack 4.

From a not shown coal dust source (coal mill or coal dust store) coal dust 13 is fed to a coal dust burner 12 arranged in a burning chamber 11; by means of a combustion air blower 14 combustion air 15 is led to the burner 12 additionally. The flue gases generated during the operation of the coal dust burner are freed from dust in a hot gas filter 16 to a sufficient degree and are admixed in the mixing chamber 8 to the part stream of cleaned boiler flue gases being fed to the mixing chamber by means of the blower 7. As hot gas filters, for example, electrostatic filters designed for high temperatures or hot gas metal-cloth filters may be used.

The leading of the entire flue gas stream through the REA 6 lies within the scope of the invention. It is further within the scope of the invention that the entire flue gas stream leaving the REA 6 is led to the mixing chamber 8. The way of operation depends on the circumstances, under which the respective power plant is operated.

Figure 2:
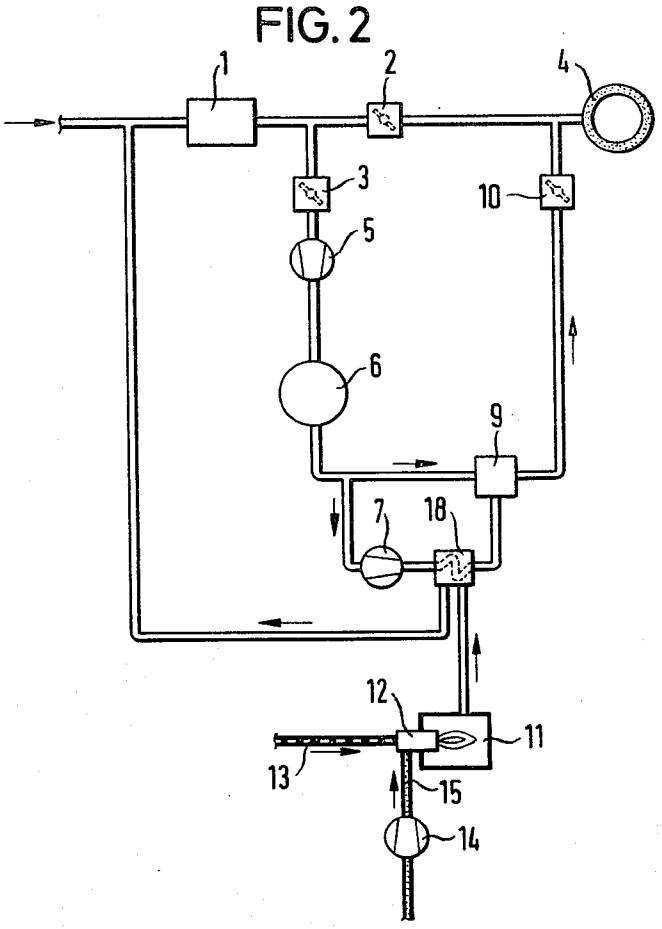
FIG. 2 shows apparatus, with which a heat exchange between the flue gases of the reheating flame and the flue gases of the power plant boiler to be reheated is performed.

In connection with FIG. 2 the same reference numbers have been used for comparable components of the apparatus.

Instead of the mixing chamber 8 a heat exchanger 18 is provided, through which the cleaned fuel gases to be reheated are passed. The heat exchanger 18 is fed with the flue gases from the burning chamber 11. The flue gases leaving the heat exchanger 18 are admixed to the flue gases from the boiler plant upstream the electro filter 1, so that the dust contained in the flue gases of the reheating flame can be removed. As heat exchangers, for example, gas-gas-countercurrent heat exchangers or rotary heat exchangers may be used.

The apparatus according to FIG. 1 may be preferably used, if a coal relatively poor in sulfur is used for the reheating, whereas the apparatus according to FIG. 2 can be operated with coal richer in sulfur, too.

With the embodiment according to FIG. 2 it is also possible, to arrange a separate dust filter before or after the heat exchanger 18 and to feed the flue gases of the reheating flame, the dust of which has been removed in this manner, already between the boiler electrostatic filter 1 and the REA 6.

We claim:

1. A process for the cleaning of flue gases heated in a coal dust fired power plant boiler comprising the steps of:

filtering the flue gases to remove dust therefrom;

wet desulfurizing at least a portion of the flue gases;

burning coal dust to provide reheating gases for the flue gases;

carrying out a heat exchange between the desulfurized flue gases and the reheating gases to reheat the flue gases for discharge from the power plant; and thereafter adding the reheating gases to the flue gases before the flue gases undergo wet desulfurization.

2. The process of claim 1 wherein the heat exchange step is further defined as carrying out a heat exchange while maintaining separate streams of flue and reheating gases.

3. The process of claim 1 wherein the reheating gases are added to the flue gases before the flue gases undergo filtering.

4. The process of claim 1 wherein the reheating gases are filtered to remove dust before adding to the flue gases.

5. The process of claim 4 wherein the reheating gases are filtered before carrying out the heat exchange.

6. The process of claim 4 wherein the flue gases are filtered after carrying out the heat exchange.

7. Apparatus for cleaning flue gases heated in a coal dust fired power plant boiler comprising:

a dust filter for receiving flue gases from the boiler and for removing dust therefrom;

a wet desulfurization means coupled to said dust filter for desulfurizing at least a portion of the flue gases;

at least one coal dust burner for providing reheating gases for the flue gases;

a heat exchanger coupled to said wet desulfurization means and said coal dust burner for carrying out a heat exchange between the desulfurized flue gases and the reheating gases to reheat the flue gases for discharge from the power plant; and conduit means coupled to said heat exchanger for adding the reheating gases to the flue gases upstream of said wet desulfurization means.

8. The apparatus of claim 7 wherein said heat exchanger is further defined as being so formed and constructed as to maintain separate streams of flue and reheating gases.

9. The apparatus of claim 7 wherein said conduit means adds the reheating gases upstream of said dust filter means.

10. The apparatus of claim 7 including dust filter means coupled to at least one of said burner and heat exchanger for removing dust from the reheating gases.

* * * * *